US005169188A

United States Patent [19]

Kupperman et al.

[11] Patent Number: 5,169,188

[45] Date of Patent: Dec. 8, 1992

[54] CERAMIC TAMPER-REVEALING SEALS

[75] Inventors: David S. Kupperman, Oak Park; Apostolos C. Raptis, Downers Grove; Shuh-Haw Sheen, Naperville, all of Ill.

[73] Assignee: The United States of America as represented by the United States Department of Energy, Washington, D.C.

[21] Appl. No.: 746,537

[22] Filed: Aug. 19, 1991

[51] Int. Cl.[5] ..... B05D 33/34

[52] U.S. Cl. ..... 292/307 R; 340/572

[58] Field of Search ..... 292/307 R, 307 A, 308; 340/572

[56] References Cited

U.S. PATENT DOCUMENTS

| | | | |
|---|---|---|---|
| 654,940 | 7/1900 | Brooks | 292/308 |
| 886,010 | 4/1908 | Murray | 292/326 |
| 2,077,209 | 4/1937 | Brooks | 292/308 |
| 4,673,922 | 6/1987 | Denis et al. | 292/307 A X |
| 4,690,443 | 9/1987 | Brammall | 292/307 R |

*Primary Examiner*—Richard E. Moore

*Attorney, Agent, or Firm*—Thomas G. Anderson; Tyrone Davis; William R. Moser

[57] ABSTRACT

A flexible metal or ceramic cable with composite ceramic ends, or a u-shaped ceramic connecting element attached to a binding element plate or block cast from alumina or zirconium, and connected to the connecting element by shrink fitting.

14 Claims, 2 Drawing Sheets

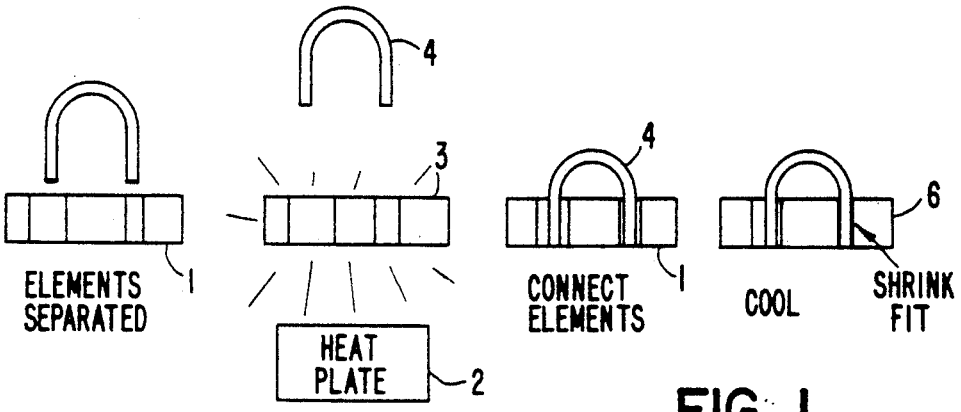
FIG. 1
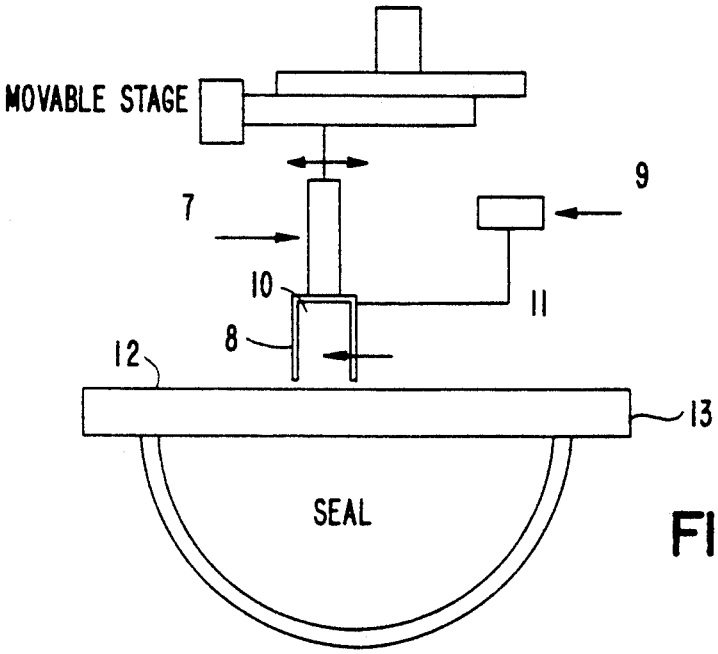
FIG. 2
FIG. 3
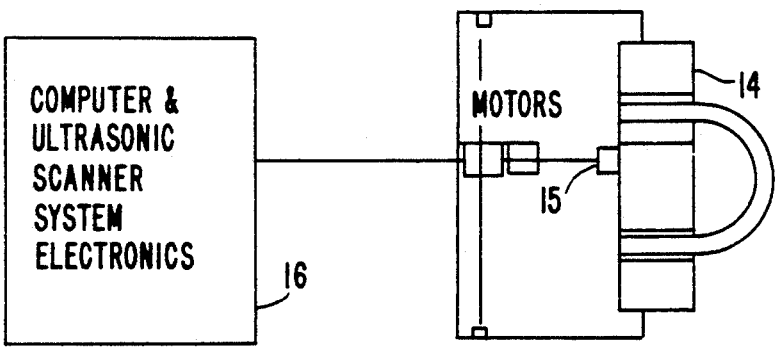

ULTRANSONIC SCAN TO CHECK FOR SEEDED DEFECT SIGNIATURE

ULTRANSONIC SCAN TO CHECK FOR SEEDED DEFECT SIGNATURE

CERAMIC TAMPER-REVEALING SEALS

CONTRACTUAL ORIGIN OF THE INVENTION

The United States Government has rights in this invention pursuant to Contract No. W-31-109-ENG-38 between the United States Department of Energy and The University of Chicago.

BACKGROUND OF THE INVENTION

This invention relates to a tamper resistant seal made of a brittle material with internal defects internally arranged in a random pattern to form a unique fingerprint characteristic of the seal which may be identified by ultrasonic scanning to determine whether the seal has been replaced or otherwise altered and tampered with.

The prior art is replete with seals and other means for sealing containers and vessels containing dangerous chemicals, chemical warfare agents, radioactive wastes, and other hazardous materials which require special care and handling. When dealing with such materials security is obviously a matter of constant concern and much money, time, and effort has been devoted to prevent misappropriations or mishaps.

In one pertinent prior art approach, the seals have been made of an optical fiber and metal construction which has addressed the need for a cost efficient tamper proof security seal. Typically, these seals have been constructed to allow periodic inspection and surveillance to detect any breakage or unauthorized replacement of the seal. Such seals have been developed for the International Atomic Energy Agency to monitor compliance with the Treaty on Nonproliferation of Nuclear Weapons to ensure that nuclear materials are not diverted for nonpeaceful purposes. In one arrangement developed by the Sandia National Laboratory, a fiber optic passive flexible cable was developed that can be wrapped around a container and secured to an assembly in which a disrupted optic signal would indicate whether the cable fibers have been broken. More particularly, a unique pattern of transmitted light, set during the assembly process by cutting a set of fibers in a special way, permits identification and an integrity check by analysis of an optical pattern that is recorded on a computer disk.

Another fairly well known type of prior art seal utilizes wire and cup sealing device. In this arrangement, a wire is threaded through the item to be sealed and the bottom of the seal, which consists of a cup made from metal stampings. The ends of the wire are joined by a crimp-type or other device and sealed in the cup. A resin in the cup provides the unique fingerprint pattern.

SUMMARY OF THE INVENTION

In the invention, a connecting element is attached to a ceramic binding element by shrink fitting. The connecting element can be either a flexible metal or ceramic cable with composite ceramic ends, or a shaped ceramic rigid element. The binding element may be either a plate or block cast from alumina or zirconium. A selected area of the binding element is cast with particles of $NiO_2$. This allows ultrasonic scanning to detect the pattern made by the particles of $NiO_2$ presenting the resulting fingerprint of the seal. The ceramic cables consist of silicon carbide fibers bundled together with ceramic membrane and jointed to ceramic plugs in a slip cast. The metal connecting element of the metal seal would consist of a flexible stainless steel wire having ceramic plug ends. Under field conditions, a fingerprint can be made and integrity checked by connecting the seal to an ultrasonic scanner. The image is then stored on a computer disk and used for comparisons with subsequent scans. The images are cross-correlated to determine if the seal has been replaced.

An ultrasonic seal is an entirely different type of device, in which an ultrasonic wave provides both a unique signature for identity and a indication of tampering. High-frequency ultrasonic waves are injected into the body of the seal, scatter off intentionally placed reflectors, and return to a sensor that allows the recording of a unique ultrasonic pattern of echoes. A reference pattern is recorded when the seal is installed and compared with subsequent patterns through a quantitative analysis.

It is therefore an object of this invention to provide a tamper resistant ceramic seal that resists state of the art tampering, operates under severe conditions, permits authentication with a single instrument, and establish identity and integrity with one interrogation.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

To achieve the foregoing and other objects and in accordance with the purpose of the present invention, as embodied and broadly described herein the invention may comprise a flexible metal or ceramic cable with composite ceramic ends, or a shaped ceramic connecting element attached to a binding element plate or block cast from alumina or zirconium, and connected to the connecting element by shrink fitting.

BRIEF DESCRIPTION OF THE DRAWINGS

The accompanying drawings, which are incorporated in and form part of the specification, illustrate an embodiment of the of the present invention and together with the description, serve to explain the principles of the invention. In the drawings:

FIG. 1 shows the sealing arrangement being connected by the shrink fit method;

FIG. 2 shows one embodiment of the seal being scanned;

FIG. 3 shows the scanning of a seal linked to a computer;

DETAILED DESCRIPTION OF THE INVENTION

Figure 4:
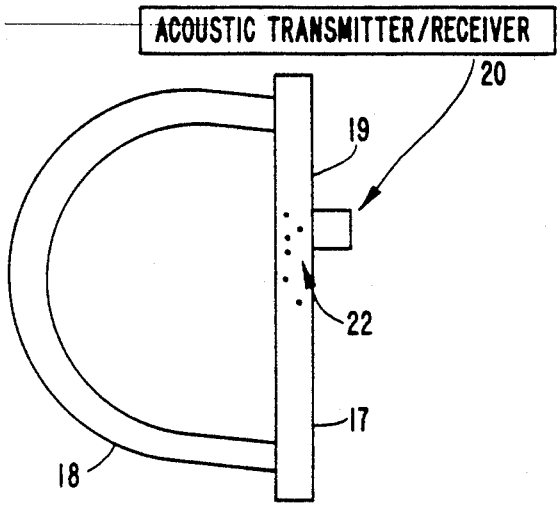
FIG. 4 shows a seal with seeded defects and a metal cable.

Referring to FIG. 1, the shrink fit method of attachment is shown. In this method the binding element 1 is heated by a heat plate 2 which allows the hole 3 to expand. The connecting element 4 is inserted into the hole 5 and the binding element 1 is allowed to cool. As it cools the hole 3 contracts to shrink fit the seal 6.

FIG. 2 shows a sealing arrangement being scanned. the transducer 7 sits atop a holder 8. The vacuum 9 evacuates air from the chamber 10. Ultrasonic scanning in a laboratory environment is very reproducible because of access to water coupling; however, field use of the ceramic seal may not permit water coupling. In that case, an alternative to water is required. A more viable scheme is to use a commercially available aqueous standoff such a the Aquaflex Ultrasonic Gel Pad manufactured by Parker Laboratories of Orange, New Jersey. An ultrasonic gel pad 11 provides good contact with a consistent reading as the transducer 7 is passed across the face 12 of the binding element 13. This particular arrangement shows a laboratory scanning apparatus with a movable stepped stage. FIG. 3 shows the ceramic seal 14 being scanned by a transducer 15 connected to computer imaging system 16.

Figure 5:
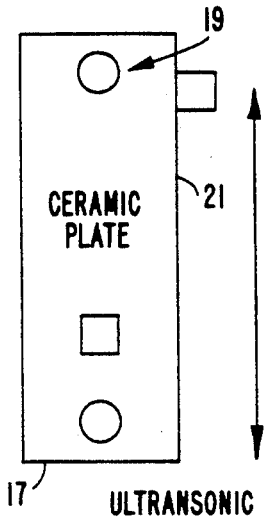
FIG. 5 shows the seal of FIG. 4 being scanned for identification.

Referring to FIGS. 4 and 5, a ceramic seal binding element 17 having a metal cable 18 with a shrink fit connection is scanned across its seeded face area 19. As the transducer 20 scans the face 19 of the binding element 17 to develop a fingerprint of the seal, the side 21 of the binding element 17 may also be scanned to produce a fingerprint of the seal 22.

Figure 6:
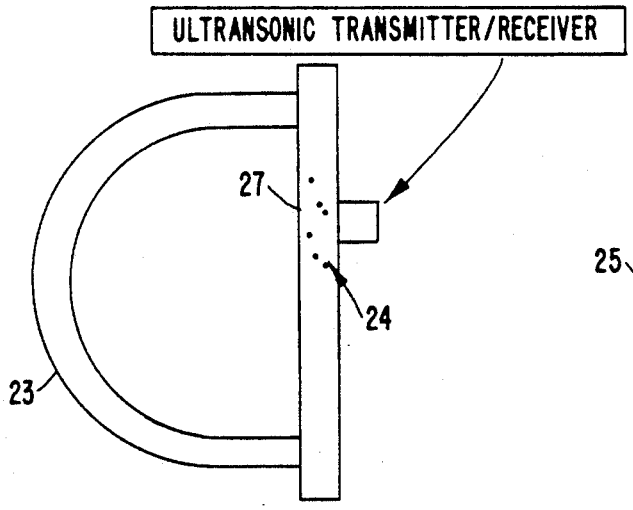
FIG. 6 shows a seal with seeded defects with a ceramic cable shrink fit to the binding element.
Figure 7:
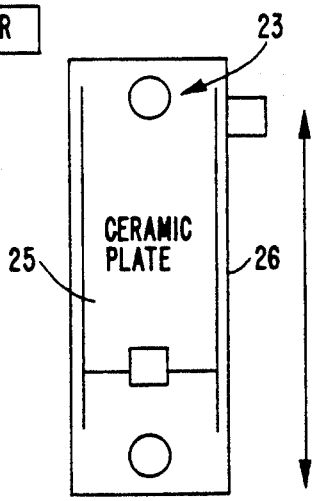
FIG. 7 shows the seal of FIG. 6 being scanned for identification.

FIGS. 6 and 7 show a ceramic flexible cable 23 shrink fit to the seeded binding element 24. The binding element 24 is scanned across its face 25 and side 26 to produce a fingerprint of the seeded area 27.

The foregoing description of the preferred embodiment of the invention has been presented for purpose of illustration and description. It is not intended to be exhaustive or to limit the invention to the precise form disclosed, and obviously many modifications and variations are possible in light of the above teaching.

The embodiments of the invention in which an exclusive property or privilege is claimed are defined as follows:

1. A tamper revealing seal comprising:

a fracturable binding element, said binding element having a face area and a side profile, and wherein said binding element includes means for identifying tampering further comprising a fixed acoustic signature; and a connecting element having two end portions and means for coupling allowing heat shrinking and said end portions to be coupled to said binding element.

2. The seal as recited in claim 1 wherein said end portions are ceramic plugs.

3. The seal as recited in claim 2 wherein said acoustic signature is a reflective indicia embedded in the material of said binding element creating a predetermined defect in said binding element.

4. The seal as recited in claim 3 wherein said connecting element is a flexible metal cable.

5. The seal as recited in claim 3 wherein said binding element is a ceramic block.

6. The seal as recited in claim 3 wherein said binding element is an alumina block.

7. The seal as recited in claim 3 wherein said binding element is a zirconium block.

8. The seal as recited in claim 3 wherein said connecting element is a ceramic cable.

9. The seal as recited in claim 1 wherein said connecting element is a rigid u-shaped ceramic member.

10. The seal as recited in claim 1 wherein said means for coupling includes at least one orifice in the face of said binding element of a predetermined size so that when heat is applied to said binding element said orifice expands and one of said two end portions of said connecting element may be inserted into said orifice and upon cooling a shrink fit occurs between said binding element and said connecting element.

11. A method of shrink fitting a ceramic seal, comprising the steps of:

providing a fracturable binding member having a face area and a side profile, including means for identifying tampering comprising an acoustic signature embedded in said binding member and having at least one cavity within said face area;

heating said binding member until said cavity expands;

providing a connecting element having two end portions, and at least one of said two end portions deposed within said cavity; and cooling said binding member until said cavity contracts and forms a shrink fit around said end portion.

12. The method as recited in claim 11 wherein said connecting element is a metal cable having ceramic plug ends.

13. The method as recited in claim 11 wherein said connecting element is a flexible ceramic cable having ceramic plug ends.

14. The method as recited in claim 11 wherein said connecting element is a rigid u-shaped ceramic member.

* * * * *